US006055998A

United States Patent [19]

Bader

[11] Patent Number: 6,055,998

[45] Date of Patent: May 2, 2000

[54] SHOCK ABSORBING FIXTURE

[76] Inventor: Michael Bader, 377 Jervis Ave., Copiague, N.Y. 11704

[21] Appl. No.: 09/246,986

[22] Filed: Feb. 9, 1999

Related U.S. Application Data

[63] Continuation-in-part of application No. 09/134,008, Aug. 14, 1998, abandoned, which is a continuation-in-part of application No. 08/929,951, Sep. 15, 1997, abandoned.

[51] Int. Cl.[7] ..... A61H 3/02

[52] U.S. Cl. ..... 135/69; 135/68; 135/69; 135/82; 135/83; 135/84

[58] Field of Search ..... 52/68, 69, 75

[56] References Cited

U.S. PATENT DOCUMENTS

| | | | |
|---|---|---|---|
| 724,382 | 3/1903 | Conn | 135/69 |
| 1,400,781 | 12/1921 | Wagner . | |
| 2,312,786 | 3/1943 | Wilson | 135/68 |
| 2,397,499 | 4/1946 | McGowan . | |
| 2,675,014 | 4/1954 | Powers . | |
| 2,856,943 | 10/1958 | Sparlin | 135/69 |
| 2,888,022 | 5/1959 | Fanning | 135/69 |
| 3,007,581 | 11/1961 | Moore | 135/69 |
| 4,881,564 | 11/1989 | Fetterman . | |
| 5,088,513 | 2/1992 | Ostermeyer . | |
| 5,341,829 | 8/1994 | Hsiao et al. . | |
| 5,402,811 | 4/1995 | Weng . | |

*Primary Examiner*—Beth A. Aubrey
*Assistant Examiner*—Dennis L. Dorsey
*Attorney, Agent, or Firm*—Collard & Roe, PC.

[57] ABSTRACT

A shock absorbing fixture for attachment to a device for aiding a user in walking such as a crutch. The fixture comprises a frame with a spring disposed within the frame that compresses under the weight of the user. The fixture is attached to the lower end of the device. The fixture reduces the shock on the user during use of the device. The device also has the capacity to be operated so that the crutch performs as a rigid crutch.

10 Claims, 4 Drawing Sheets

SHOCK ABSORBING FIXTURE

This application is a continuation-in-part of U.S. patent application Ser. No. 09/134,008, filed on Aug. 14, 1998, abandoned which is a continuation-in-part of U.S. patent application Ser. No. 08/929,951 filed on Sep. 15, 1997, abandoned.

BACKGROUND OF THE INVENTION

1. Field of the Invention

The present invention relates generally to shock absorbing attachments. More particularly, the present invention relates to an attachment fixture having a shock absorbing frame that is attached to a supporting foot of a device for assisting a user in walking, to minimize the impact to the user.

2. The Prior Art

Many known items have incorporated various foot designs to minimize the impact or shock on both the item to which the foot is attached as well as to the user and the underlying surface. Crutches, for example, traditionally incorporate a fixed length frame having a cushioned upper end for placement within the underarm of the user, and a lower end configured to grip the ground or other supporting surface. The design of the basic crutch described above has experienced many improvements with the advent of lighter and stronger materials. Further improvements in crutch design have included various fixtures and attachments which partially absorb the impact of the crutch with the supporting surface. However, those people needing crutches come in an infinite number of heights, weights, arm lengths, strengths and stability. Unfortunately, it often happens that a person needing a crutch must settle for a fixed feature crutch that cannot be readily modified to meet the specific attributes of the user. Those who have employed such permanent design crutches have experienced underarm soreness, as well as arm and wrist strain, all of which diminish the benefits of the crutch. Other devices having shock absorbing feet include walkers and canes. The feet of both walkers and canes used by the elderly and other handicapped people have been modified to assist the user in both supporting themselves and gripping the underlying surface.

Various shock absorbing devices have been developed in the prior art that incorporate complex designs to minimize the shock on the arms and hands of the user. Unfortunately, these devices fail to address a common situation, namely that many users already possess crutches, walkers, canes, and other devices and are not able to afford these complex and expensive devices with built-in shock absorbing assemblies. Although the prior art includes various permanent shock absorbing assemblies built into crutches, walkers, canes and other devices, a need exists for an after market shock absorbing fixture that can be readily attached to the feet of existing crutches, walkers, canes and other devices.

SUMMARY OF THE INVENTION

It is therefore an object of the present invention to provide an after market shock absorbing fixture that can be readily attached to the feet of existing crutches, walkers, canes and other devices.

It is anther object of the present invention to provide a shock absorbing fixture that is simple to operate.

It is a further object of the present invention to provide a shock absorbing fixture that is lightweight, strong and safe to use.

It is yet another object of the present invention to provide a shock absorbing fixture that reduces the strain on the user.

It is yet a further object of this invention to provide a fixture that can be easily converted from rigid to shock absorbing.

These and other objects are accomplished by a shock absorbing fixture according to the invention comprising a frame made of a lightweight aluminum alloy having a leg tube with a bore therethrough. The leg tube is dimensioned to be inserted into a bore in the device for aiding a user in walking. The shock absorbing fixture is movable in relation to the device between a resting position and a stressed position, the shock absorbing fixture having a maximum length when the shock absorbing fixture is in the resting position and a minimum length when the shock absorbing fixture is in a stressed position.

A flexible spring clip is mounted to the frame and defines a pair of heads dimensioned for selective placement into and out of a set of holes in the existing device. The spring clip permits the user to easily attach the fixture to the device, and allows the user to vary the length of the frame through insertion into desired set holes in the walking device. This is important because users of different sizes must be able to use the device and fixture.

A foot is secured to the lower end of the frame and is constructed from a rubber based material. The foot is adapted to grip the underlying surface. Preferably, the lower end of the frame has inwardly-curved edges and is covered by a metal cap. This ensures that the frame will not penetrate the foot over time.

A spring is provided which has a first end secured to the tube, and a second end secured to a shaft. The spring is configured to resist movement of the second end from the resting position to the stressed position. The spring has a defined level of resistance and is configured to permit movement of the second end from the resting position to the stressed position only in response to force on the second end that is greater than a defined level of resistance. In a preferred embodiment, the spring is a "self-adjusting" spring, in which the coils of the spring vary from loose to tight from the bottom to the top of the spring. This creates a resistance on the spring that is weight-dependent. Therefore, the spring adjusts to the amount of pressure applied to it: a low amount of pressure will affect only the loosely wound coils and create a softer resistance while a higher amount of pressure will affect all of the coils and create a stronger resistance.

In a preferred embodiment, there is a tension adjusting screw mounted within the attachment to adjust the resistance against the spring to evenly balance the distribution of compression. The screw also works as a cylinder sweep and prevents the inner tube from becoming misaligned when moving vertically. The screw also works as a lubricating lock in the same way as a retaining ring would work on piston head in a car engine. The screw redistributes the necessary lubricants located inside the tube to prevent wear while keeping the lubricants from leaking out of the bottom of the attachment.

There is also a compression fitting in the form of a thumb screw surrounding the tube of the attachment which is screwed onto the end of the walking device. The compression fitting allows the user to have the option of a device that is either rigid or flexible. When the compression fitting is manually tightened, it squeezes a nylon compression ring against the tube of the attachment and prevents the tube from rotating or moving in a vertical direction. To have the invention operate in a shock absorbing capacity, the compression fitting is loosened, which allows the tube to move vertically, as well as with a 360° rotation.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
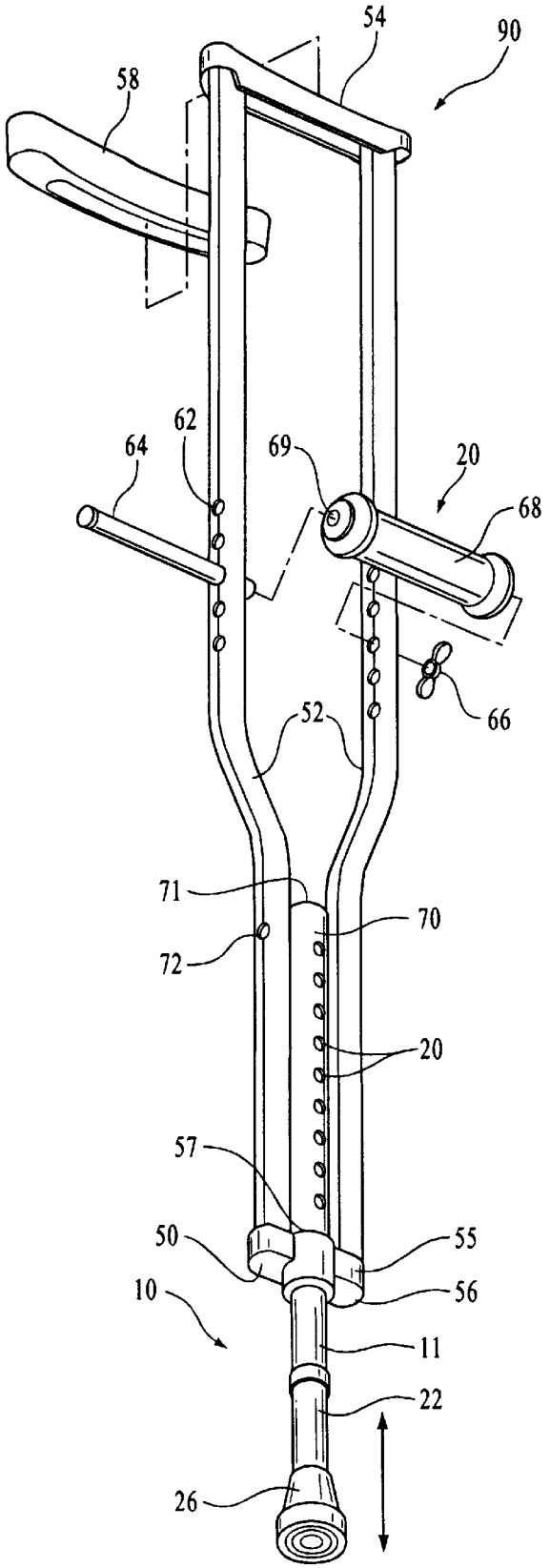
FIG. 1 is an exploded view of a shock absorbing fixture according to the invention attached to a crutch.

Referring now in detail to the drawings and, in particular, FIG. 1, there is shown a shock absorbing fixture 10 including various components of an aluminum alloy, although other strong and lightweight materials could also be used. Hollow lower leg tube 11 is slidably disposed within bore 71 in upper leg tube 70 in crutch 90 and extends through bore 57 in collar 55 in crutch 90. Spring clip 14 forms heads 16 at either end which extend out through holes 18 in lower leg tube 11. Heads 16 are positioned by the user within desired ankle set holes 20 by squeezing the heads 16 of spring clip 14 toward one another. The user can vary the length of crutch 90 through placement of heads 16 of spring clip 14 in a desired ankle set holes 20.

Shaft 22 is partially disposed within bore 12 of lower leg tube 11 and extends at one end therefrom. A flange 29 fits around lower leg tube 11 and facilitates sliding of shaft 22 in relation to lower leg tube 11, as well as acts as a water seal between lower leg tube 11 and shaft 22. Fitted onto lower end 24 of shaft 22 is a foot 26. Foot 26 is configured to grip the floor or other underlying surface and accordingly is made from rubber, although other materials providing enhanced gripping features can also be used. Shaft 22 is slidably disposed within bore 12 in lower leg tube 11. Spring 30 is also disposed within bore 12 in lower leg tube 11 and is secured at a top end 30*a* by post 32 which is disposed through post holes 34 in lower leg tube 11.

Crutch 90 includes a pair of elongated hollow side bars 52 joined at one end by a cross bar 54 and at another end by a collar 55. Referring to FIG. 1 in conjunction with FIG. 2, collar 55 has a pair of cups 56 adapted to receive respective ends of side bars 52. Collar 55 defines a bore 57 positioned between cups 56.

Underarm cushion 58 is positioned around cross bar 54 and is designed to comfortably engage the armpit of the user. Cross bar 54 can be fitted with various sizes of underarm cushion 58 to accommodate the weight and desired comfort of the user. Handle 20 is disposed between side bars 52 and is secured to side bars 52 by bolt 64, which is positioned through one of through holes 62 and is fastened therethrough by wing nut 66. The location of handle 60 can be readily changed by the user to accommodate desired arm length and can be hand positioned by positioning bolt 64 through appropriated through hole 62. Hand cushion 68 is fitted to handle 60 by inserting handle 60 through an internal bore 69 in hand cushion 68. Hand cushion 68 is constructed of a padded rubber material to facilitate the gripping of crutch 90 by the user.

Figure 2:
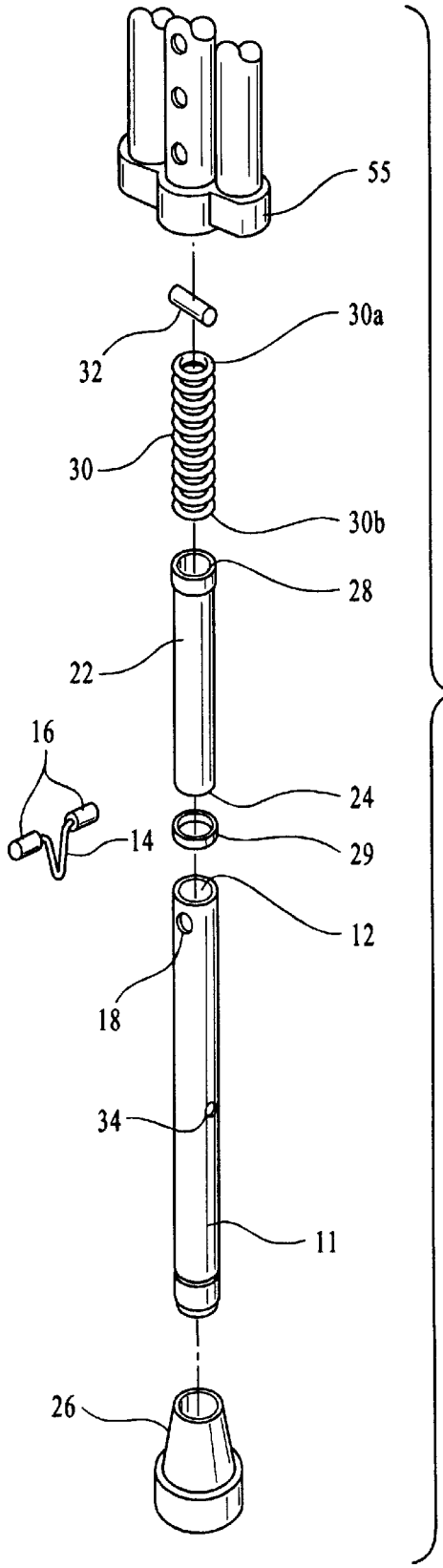
FIG. 2 is a partial exploded view of the shock absorbing fixture according to FIG. 1.

Referring to FIGS. 1–2, upper leg tube 70 is positioned between side bars 52 and extends at one end into bore 57 in collar 55. Upper leg tube 70 defines an internal bore 71 and a plurality of spaced ankle set holes 20 extending therethrough. Upper leg tube 70 is secured to side bars 52 by a fixed pin 72 which extends through holes (not shown) in both side bars 52 and upper leg tube 70. Fixed pin 72 along with collar 55 prevent movement of upper leg tube 70.

Figure 3:
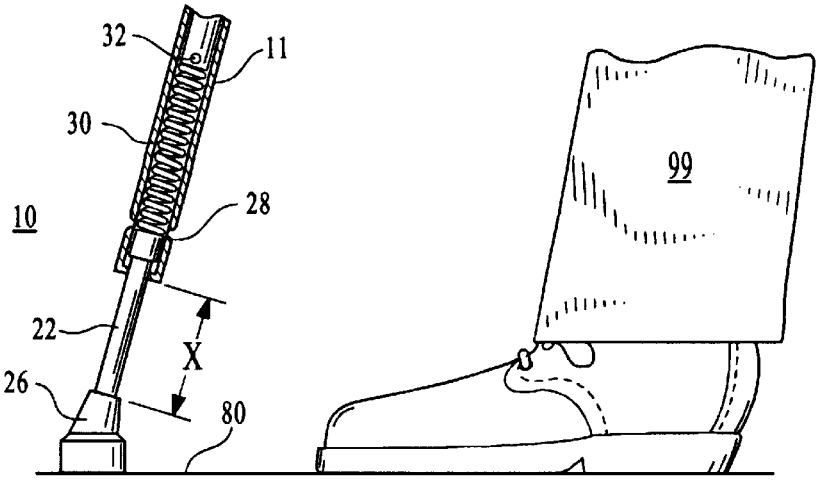
FIG. 3 is a partial view of the shock absorbing fixture according to FIG. 1 displaying the shock absorbing fixture engaging the ground during a first portion of a user step.
Figure 4:
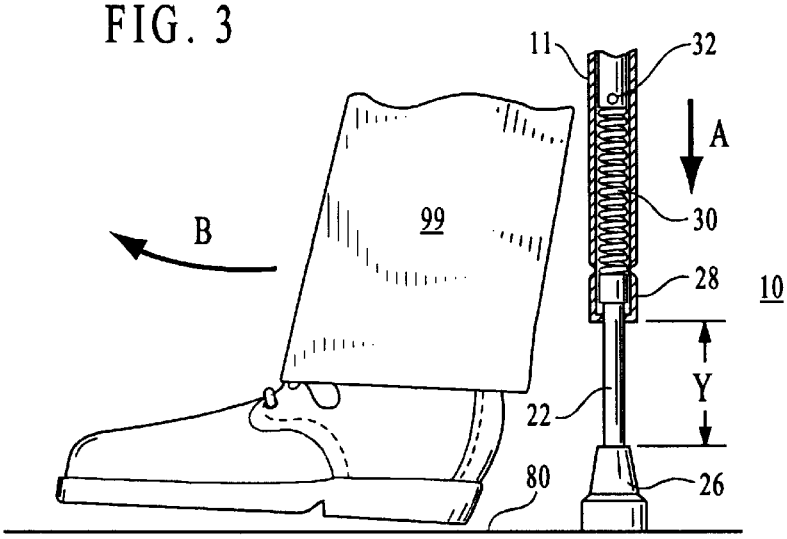
FIG. 4 is a partial view of the shock absorbing fixture according to FIG. 1 displaying the fixture engaging the ground during an intermediate portion of a user step.
Figure 5:
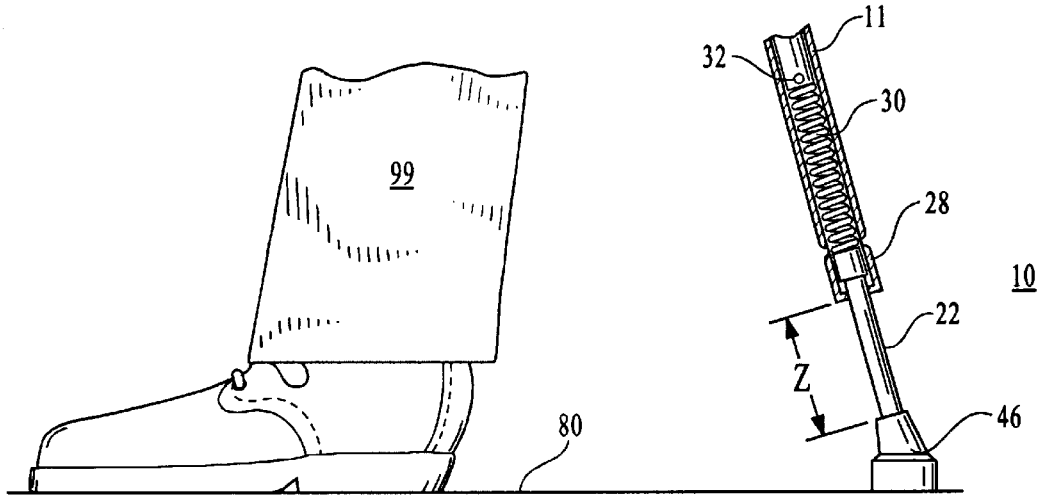
FIG. 5 is a partial view of the shock absorbing fixture according to FIG. 1 engaging the ground during a final portion of a user step.

Referring now to FIGS. 3–5 in conjunction with FIG. 1, the operation of fixture 10 will be described with respect to a user who requires support on the right side of the user's body. Underarm cushion 58 is placed by the user into the right armpit of the user (not shown), the user gripping hand cushion 68 with his right hand. Referring now to FIG. 3, during the first stage of the step, the user places foot 26 of fixture 10 onto floor 80, the exposed length of the shaft having a first length "x" with spring 30 being fully expanded at a rest position. Referring now to FIG. 4, as the user commences the intermediate position of a step, the user places weight downward on crutch 90. The downward force of the user on crutch 90 results in an opposite force upward from floor 80 and through the foot 26 and onto shaft 22. Shaft 22 transfers the force at upper end 28 to spring 30. Spring 30 in turn compresses in response to this force and the exposed length of shaft 22 decreases to a length "y". The compression of spring 30 absorbs a portion of the shock the underarm of the user receives when a load is placed on crutch 90 by a user. The spring constant K of spring 30 is appropriate for the size and capability of a particular user. Each subsequent user should accordingly select a fixture 10 with a lower leg tube 11 having a spring with a desired spring constant K.

Referring now to FIG. 5, as the user enters the final portion of the step, the user transfers weight to his left leg (not shown), thereby decreasing the force placed onto crutch 90. Spring 30 expands in response to the decrease in force on crutch 90, increasing the exposed length of shaft 22 to a value of "z" and giving upward support to the user to complete the step.

Figure 6:
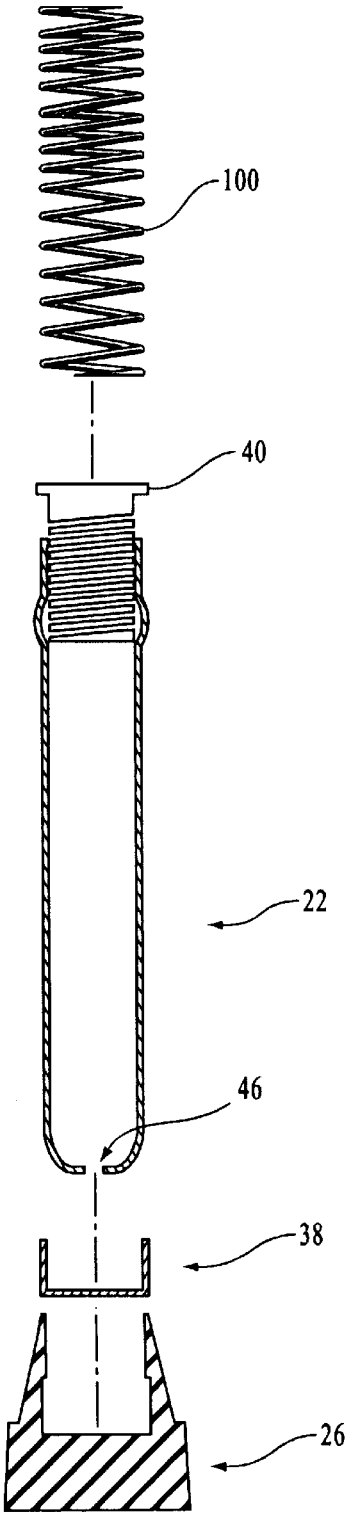
FIG. 6 shows an exploded cross sectional view of the second end of the frame and the foot, with an alternative version of the spring.

As shown in FIG. 6, the lower end of shaft 22 has inwardly curved edges and is covered by a cap 38 within foot 26. This configuration ensures that shaft 22 will not penetrate foot 26 over time.

As shown in FIG. 6, spring 100 can be used with the fixture according to the invention. Spring 100 is a "self-adjusting" spring that has tighter coils at the top and looser coils at the bottom. A lower amount of pressure will only cause the lower, more loosely coiled portion to compress, and create a softer resistance. As the pressure increases, more and more of the spring is compressed and the resistance increases. Therefore, the same spring can be used with users of many different weights.

Figure 7:
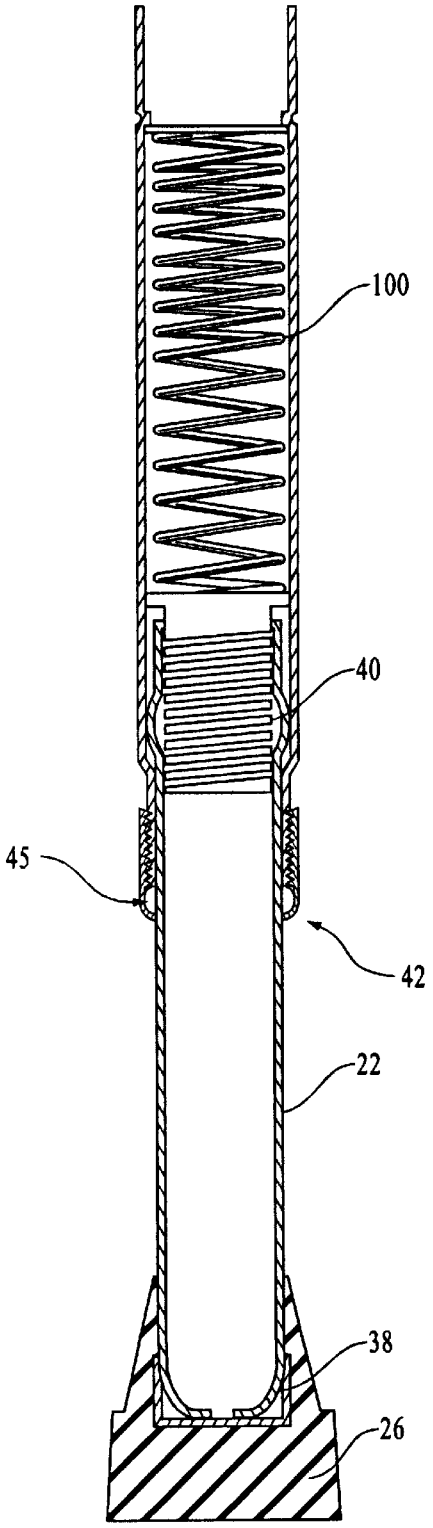
FIG. 7 shows a longitudinal cross-sectional view of the preferred embodiment of the device according to the invention mounted within a crutch.

There is a tension adjusting screw 40 mounted within shaft 22 and extending within lower leg tube 11, as shown in FIGS. 6 and 7. Screw 40 controls the resistance of spring 100 to provide an evenly balanced distribution of the compression. Screw 40 is adjusted by inserting a screwdriver through hole 46 in shaft 22. Screw 40 also works as a stabilizer and prevents shaft 22 from being misaligned during vertical movement. Screw 40 also works as a lubricating lock to redistribute necessary lubricants inside shaft 22 to prevent wear while keeping the lubricants from leaking out the bottom of the fixture.

There is a compression fitting in the form of a thumb screw 42 mounted around shaft 22 and engaging the end of lower leg tube 11 via interlocking threads. There is a nylon O-ring 45 mounted within thumb screw 42 so that tightening screw 42 causes O-ring 45 to squeeze against shaft 22 and prevent it from moving vertically or rotating. In this manner, the device operates in the same way as a rigid crutch. If the user desires to use the shock absorbing capacity of the crutch, thumb screw 42 is merely loosened, which allows vertical and rotational movement of shaft 22.

Accordingly, while only a few embodiments of the present invention have been shown and described, it is obvious that many changes and modifications may be made thereunto without departing from the spirit and scope of the invention.

What is claimed is:

1. A shock absorbing fixture for attachment to a device for aiding a user in walking, the device having a plurality of set holes, comprising:

a hollow frame having a first end and a second end, the second end being movable in relation to the first end between a resting position and a stressed position, the frame having a maximum length when the second end is in the resting position and a minimum length when the second end is in the stressed position, the second end being adapted for placement onto an underlying surface;

means for attaching the frame to the device for aiding the user in walking such that the frame is inserted within an end of the device;

means for adjusting the position of the frame on the device for aiding the user in walking so as to adjust the total length of the combined frame and device;

shock absorbing means secured to the frame, the shock absorbing means configured to resist movement of the second end from the resting position to the stressed position, the shock absorbing means having a defined level of resistance and being configured to permit movement of the second end from the resting position to the stressed position only in response to force on the second end which is greater than a defined level of resistance;

a tension adjusting screw mounted in the frame adjacent the shock absorbing means, wherein turning the screw changes the resistance of the shock absorbing means; and means for selectively tightening the frame to prevent movement from the resting position to the stressed position.

2. The fixture according to claim 1, wherein the means for adjusting the position of the frame comprises a flexible spring clip mounted to the frame, the spring clip defining at least one head dimensioned for selective placement into and out of the set holes in the device.

3. The fixture according to claim 1, further comprising a foot secured to the second end of the frame, the foot being adapted to grip the underlying surface.

4. The fixture according to claim 3, further comprising a cap over the end of the second end of the frame, and disposed within the foot, said cap preventing the second end of the frame from penetrating the foot with repeated use.

5. The fixture according to claim 4, wherein the second end of the frame is curved inward so that the second end takes on a rounded shape.

6. The fixture according to claim 1, wherein the frame comprises a tube defining an internal bore and a shaft partially disposed within the bore of the tube.

7. The fixture according to claim 6, wherein the shock absorbing means comprises a spring having a first end secured to the tube and a second end secured to the shaft.

8. The fixture according to claim 7, wherein the spring is a vinyl coated spring.

9. The fixture according to claim 7, wherein the spring is coiled loosely at its second end and more tightly at its first end, so that the tension in the spring adjusts to the weight of a user using the fixture.

10. The fixture according to claim 1, wherein the means for selectively tightening the frame comprises an internally threaded thumb screw mounted around the second end and engaging external threads on the first end, and an O-ring mounted within the thumb screw, such that tightening the thumb screw squeezes the O-ring around the second end and prevents movement between the resting and stressed positions.

* * * * *